United States Patent [19]

Piffath et al.

[11] 4,181,493

[45] Jan. 1, 1980

[54] GAS LIGHTER HAVING SLIDABLY DETACHABLE HEAD ASSEMBLY

[75] Inventors: Rodney S. Piffath, Northridge, Calif.; John J. Cole, New York, N.Y.

[73] Assignee: International Fire Tool Corp., New York, N.Y.

[21] Appl. No.: 695,440

[22] Filed: Jun. 14, 1976

[51] Int. Cl.[2] ..... F23Q 2/16

[52] U.S. Cl. ..... 431/344; 431/254; 431/277

[58] Field of Search ..... 431/344, 277, 276, 254; 222/141, 5, 3, 399

[56] References Cited

U.S. PATENT DOCUMENTS

| | | | |
|---|---|---|---|
| 3,174,310 | 3/1965 | Genoud | 431/344 |
| 3,523,005 | 8/1970 | Piffath et al. | 431/277 |
| 3,523,006 | 8/1970 | Piffath et al. | 431/277 |
| 3,709,462 | 1/1973 | Piffath et al. | 137/845 |
| 3,740,183 | 6/1973 | Piffath et al. | 431/344 |
| 3,800,979 | 4/1974 | Piffath et al. | 137/322 |
| 3,963,413 | 6/1976 | Lockwood et al. | 431/344 |
| 3,966,392 | 6/1976 | Lockwood | 431/344 |

FOREIGN PATENT DOCUMENTS

| | | | |
|---|---|---|---|
| 1371895 | 7/1963 | France | 431/344 |

*Primary Examiner*—Edward G. Favors
*Attorney, Agent, or Firm*—Francis N. Carten

[57] ABSTRACT

A gas lighter is formed by a head assembly which incorporates all of the valving, regulation and ignition functions and is slidably and detachably connected to a fuel cartridge having a valve assembly through which the head assembly is fluidly coupled to the fuel supply. The fuel cartridge may be stored indefinitely apart from the head assembly, and may be either disposed of and replaced, or refilled, when its fuel is exhausted.

21 Claims, 6 Drawing Figures

GAS LIGHTER HAVING SLIDABLY DETACHABLE HEAD ASSEMBLY

BACKGROUND OF THE INVENTION

U.S. Pat. Nos. 3,523,005, 3,523,006 and 3,709,462 teach the construction of gas lighters in which the flow of gas to the outlet port is controlled by rotating the head assembly which is threadedly attached to the fuel cartridge, thereby varying the degree of penetration of the tapered end of a solid screw into a penetrable end of the cartridge. Thus, gas valving and regulation were both effected by rotation of the head assembly to alter its co-operative relationship with the fuel cartridge. The gas lighter embodying the present invention incorporates a head assemly which is slidably attached to a fuel cartridge, and is therefore readily detached from and attached to the fuel cartridge in one quick, easy motion. The fuel cartridge includes a valve assembly which is disclosed and claimed in U.S. Pat. No. 3,800,979 issued on Apr. 2, 1974, the disclosure of which is hereby incorporated into this application by reference. The fuel cartridge is slotted and chambered to slidably receive and retain the head assembly between two opposed retaining members which exert lateral mechanical pressure on the head assembly.

The gas valving, regulating and igniting functions all reside exclusively in the head assembly in the present invention. Thus, there is no need to alter the co-operative relationship between the head assembly and the fuel cartridge, once they have been attached, in order to effect valving or regulation of gas flow to the burner orifice.

SUMMARY OF THE INVENTION

The present invention is embodied in and carried out by a gas lighter, and the head assembly and fuel cartridge forming said gas lighter, in which the head assembly is slidably attachable to and detachable from the fuel cartridge, which exerts mechanical retaining forces on the head assembly when the two are attached. The valving and regulation of the flow of gas from the fuel cartridge to a burner orifice in the head assembly, and ignition of the gas at the burner orifice, are all performed entirely with the head assembly.

BRIEF DESCRIPTION OF THE DRAWINGS

The present invention may be better understood by reading the written description thereof with reference to the accompanying drawings, of which.

DETAILED DESCRIPTION OF THE PREFERRED EMBODIMENT

Figure 1:
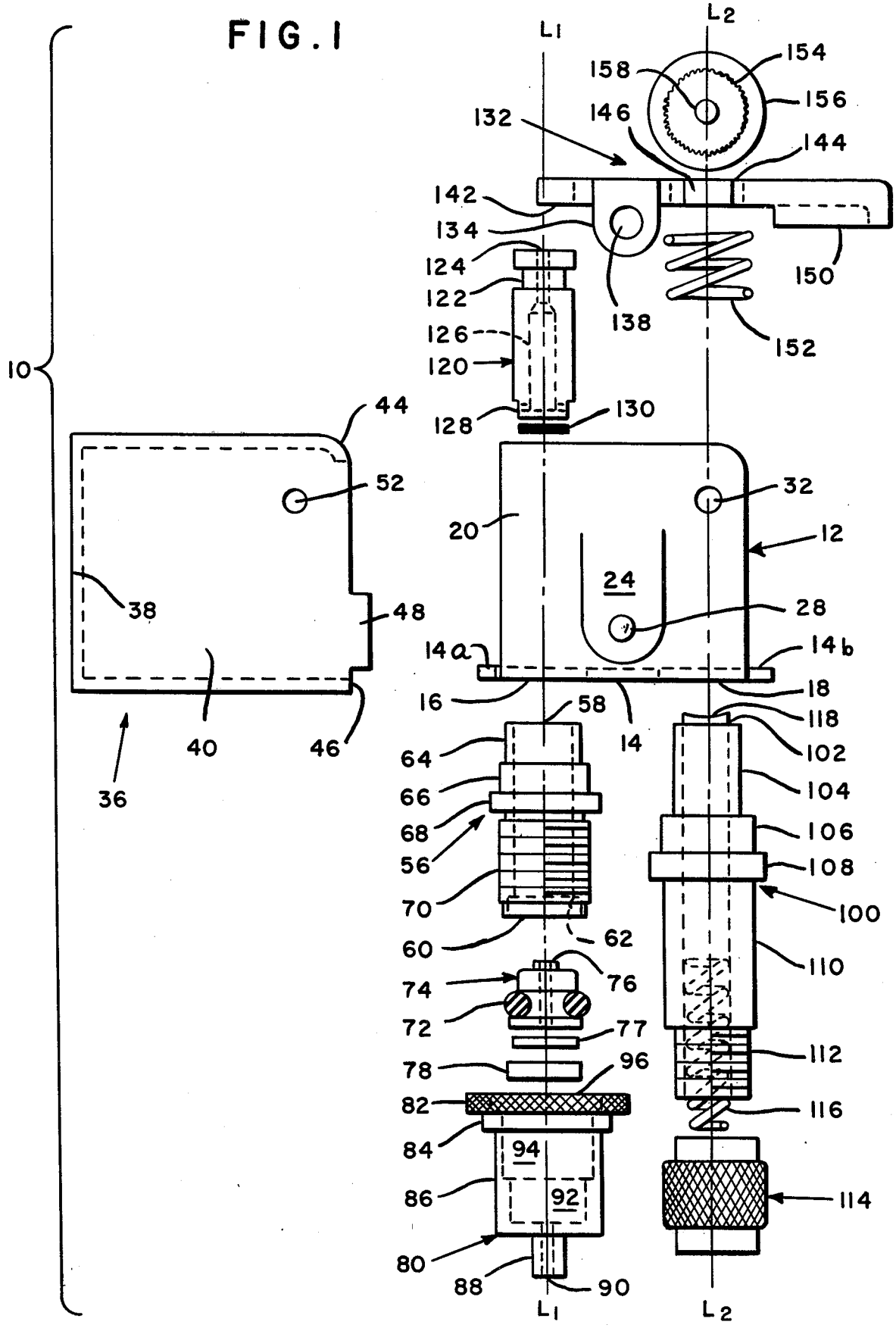
FIG. 1 is an exploded side elevation of the head assembly for the gas lighter which is the preferred embodiment of the present invention.

Referring specifically to FIGS. 1, 4, 5 and 6, the head assembly 10 and the various components thereof are depicted. The U-shaped head frame 12 has a floor 14 with arcuate ends 14*a* and 14*b* and holes 16 and 18 extending therethrough. Side walls 20 and 22 rise perpendicularly from floor 14 in opposed relationship to one another. Wings 24 and 26 die-cut in the side walls 20 and 22, and dimples or protrusions 28 and 30 are formed near the free ends of wings 24 and 26. Opposed holes 32 and 34 are formed in side walls 20 and 22 for mounting the sprarking wheel axle. A head sleeve 36, preferably nickel-plated, includes a front wall 38 and opposed side walls 40 and 42. An upper rim 44 extends inwardly from the upper edges of front wall 38 and side walls 40 and 42, and a lower rim 46 extends inwardly from the lower edges of front wall 38 and side walls 40 and 42. Locking tabs 48 and 50 extend from one end of side walls 40 and 42. Opposed holes 52 and 54 are formed in side walls 40 and 42 for the sparking wheel axle. These holes may be eliminated, with the sparking wheel axle being retained exclusively by the holes in the head frame 12.

A metal valve screw 56 includes a bore 58, an enlarged bore 60 and a shoulder 62 formed between bores 58 and 60. An extension 64 is passed through hole 16 in the floor 14 of head frame 12, and locking collar 66 is fitted through hole 16 and staked to retain valve screw 56 in place. A limiting collar 68 abuts the bottom side of floor 14. A threaded portion 70 depends from limiting collar 68.

O-ring 72 is mounted on a metal O-ring carrier 74, which has a passage 76 extending axially therethrough along the longitudinal axis L-1. The upper end of O-ring carrier 74 fits into bore 58 of valve screw 56, while O-ring 72 fits into a chamber partially defined by the enlarged bore 60 in valve screw 56. A metal disc 77 of lesser diameter than the compressible regulation pad 78 lies between O-ring carrier 74 and pad 78, which is of a random filament nylon or dacron, such as NOMEX, or of sponge urethane. Valve cap 80 is formed of nylon, and includes a knurled flange 82, a collar 84, a sleeve 86 which is closed at the bottom, and a nipple 88 extending from the closed bottom of sleeve 86. A passage 90 extends axially through nipple 88 into a lower chamber 92 which is in communication with a larger upper chamber 94 and a widened opening 96. The interior of valve cap 80 is unthreaded, and it may therefore be simply snapped onto metal valve screw 56, with the nylon forming its own threads. Thus, the manufacturer of the head assembly 10 is greatly facilitated by taking advantage of the shape memory of nylon in this fashion. The compressible regulation pad 78 fits into chamber 92 and is variably compressed therein by rotating valve cap 80 by means of knurled flange 82 to move the valve cap 80 up or down along the axial length of valve screw 56.

Flint tube 100 defines a cylindrical bore 102 disposed along axis L-2. An extension 104 is passed through hole 18 in floor 14 of head frame 12, with locking collar 106 being fitted through hole 18 and staked to secure the flint tube 100 to head frame 12. Limiting collar 108 rests against the bottom surface of floor 14. Sleeve 110 extends below limiting collar 108, and a threaded portion 112 depends from sleeve 110. A cap 114 having a threaded interior and, preferably, a knurled exterior seals the open bottom end of flint tube 100 and retains spring 116 and flint 118 therein.

The valve tube 120 is disposed along longitudinal axis L-1 in bore 58 of valve screw 56. An annular groove 122 is formed in valve tube 120 adjacent burner orifice 124. An axial passage 126 is formed in valve tube 120, which is closed at its bottom end except for a diametrical transverse passage 128 which intersects with axial passage 126 to provide fluid communication therethrough to burner orifice 124. An elastomeric sealing member 130 of irregular shape, e.g., triangular, lies between the bottom of valve tube 120 and the opening of passage 76 at the top of O-ring carrier 74.

An actuating lever 132 is formed with vertically depending tabs 134 and 136 having mounting holes 138 and 140 formed therein. A notch 142 is formed at one end of lever 132 to engage the annular groove 122 in valve tube 120. A hole 144 is formed in the horizontal portion of lever 132 so that extension 104 of flint tube 100 may pass therethrough. Tabs 146 and 148 are formed adjacent hole 144. A dished, widened portion 150 is provided for thumb engagement to actuate the lever. A lever spring 152 is placed between lever 132 and locking collar 106 of flint tube 100, encircling extension 104 of flint tube 100. Thus, the lever 132 is automatically returned to its normal position when the user removes thumb pressure from the widened portion 150. A conventional sparking wheel 154 is mounted between the two portions of a split thumb wheel 156 and is mounted by means of axle 158 in the opposed holes 32 and 34 of head frame 12 and the opposed holes 52 and 54 of head sleeve 36.

Figure 2:
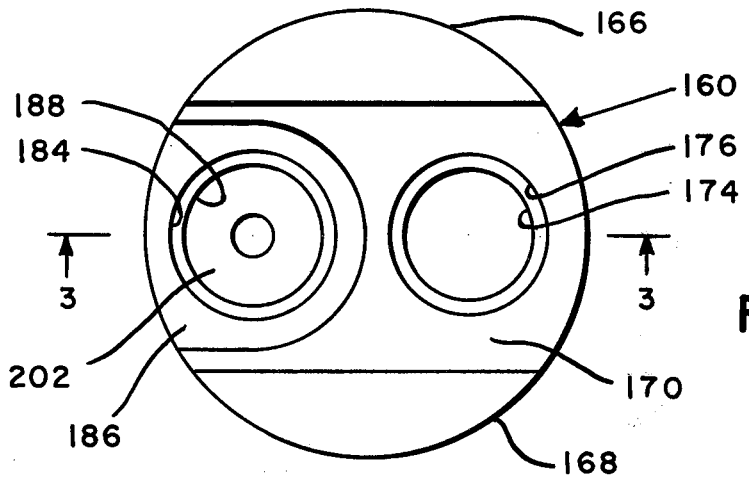
FIG. 2 is a top elevation of the fuel cartridge for the gas lighter which is the preferred embodiment of the present invention.
Figure 3:
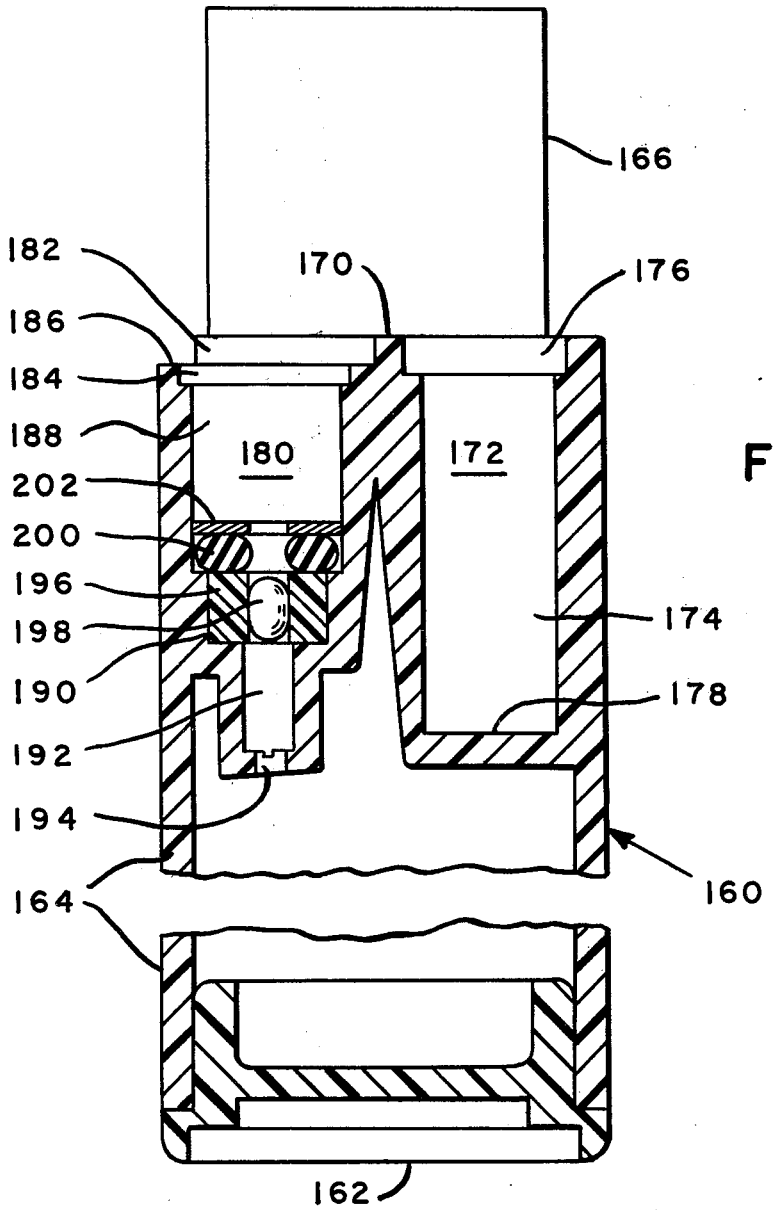
FIG. 3 is a sectional side elevation of the fuel cartridge of FIG. 2 taken along line 3—3.
Figure 6:
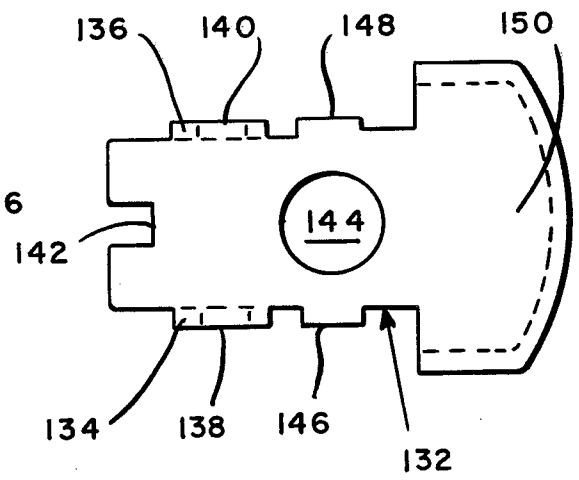
FIG. 6 is a top elevation of the lever of FIG. 1.

Referring now specifically to FIGS. 2 and 3, the fuel cartridge 160 of applicant's gas lighter is depicted there. After introduction of the fuel, preferably liquified natural gas, a nylon plug 162 is fitted into the open end of nylon tank 164 and the two pieces are spin-welded together to form a closed chamber for the fuel. At the other end of fuel cartridge 160, head assembly retaining members 166 and 168 extend vertically upward from floor 170. A chamber 172 extends down from floor 170 into the tank 164 to provide a space for the flint tube of the head assembly. There is a clearance fit between the flint tube 100 with its cap 114 and the walls of chamber 172. Chamber 172 includes a cylindrical portion 174 with a widened recess 176 at the opening in floor 170, with a chamber floor 178 being formed at the closed end thereof. Another chamber 180 is formed to receive the valve screw and cap 56 and 80, respectively. This chamber 180 includes a widened recess 182 extending down from floor 170 with a lateral opening for the knurled flange 82 of valve cap 80, thereby enabling rotation of the valve cap by the user so as to effect regulation of the flow of gas by varying the compression of regulation pad 78. A disc-shaped bore 184 extends down from widened recess 182 to form a sub-floor 186 therebetween. A first cylindrical bore 188 depends from disc-shaped bore 184, and a second, smaller cylindrical bore 190 depends from first cylindrical bore 188. A passage 192 connects the second cylindrical bore 190 with an opening 194 into the fuel tank. An elastomeric sleeve 196 is interference fitted into second cylindrical bore 190, and a metal piston (preferably brass or aluminum) 198 is force fitted into the elastomeric sleeve 196. An O-ring 200 overlies elastomeric sleeve 196 and is held in place in the first cylindrical bore 188 by a lock washer 202.

Figure 5:
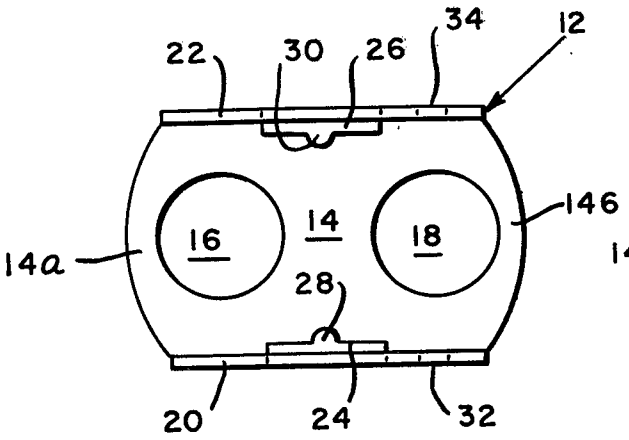
FIG. 5 is a top elevation of the head frame of FIG. 1.
Figure 4:
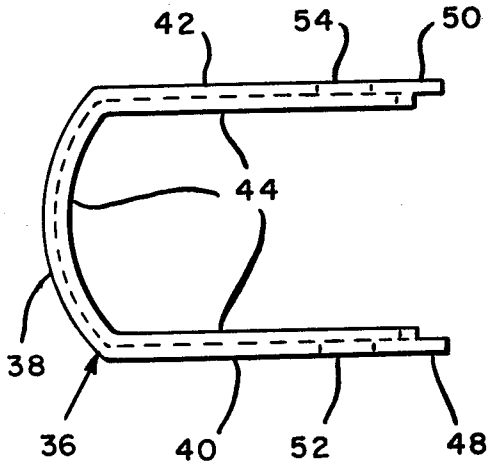
FIG. 4 is a top elevation of the head sleeve of FIG. 1.

A number of advantages are secured by the construction just described. First, there has been eliminated the usual pin about which the actuating lever is fulcrummed. By employing inwardly-extending dimples 28, 30 formed near the free ends of wings 24 and 26, which are in turn deflected inwardly as shown in FIG. 5, the lever 150 shown in FIG. 6 may be readily mounted without the use of a pin, and therefore more expeditiously. Once the lever 150 has been so mounted, the head sleeve 36 is fixed to the head frame 12 to prevent the inwardly-deflected wings 24 and 26 from being forced outwardly to a point where the lever could become detached. The head sleeve 36 may, of course, be employed to bear the name of a company, or a trademark, or any legend or design one may choose. Also, the use of opposed retaining members formed in the upper end of the fuel cartridge to hold the slidably detachable head makes it possible to eliminate the usual means of mechanical attachment, such as a screw or a clamp. With regard to the head assembly, all of the valving, regulation and ignition functions are performed by means of the head assembly. Thus, the construction of the fuel cartridge is simplified and therefore made less expensive. The fuel cartridge may therefore be readily discarded, with the head assembly being fitted into a replacement cartridge. The manner in which the regulator assembly is formed facilitates both manufacturer and maintenance of the head assembly of the lighter. Specifically, by employing a valve cap 80 which is unthreaded but is made of a material having shape memory, such as nylon or the ethylenes or polypropylenes and certain urethanes in the flexible range, or synthetic or natural rubber or any elastomeric material, it is possible to simply force the valve cap over metal the valve screw 56. After being forced onto the valve screw 56, the valve cap 80 will form its own threads due to the tendency of the material to try to return to its original shape and, specifically, to its inner diameter which in the present case is less than the maximum diameter of the threaded section of the valve screw 56. Because the fuel tends to leave behind a waxy residue on the compressible regulation pad 78 and the other adjacent parts, it is desirable to clean the regulator after extended periods of usage. This cleaning task is facilitated by the valve cap 80 with shape memory, in that it may be removed in the same manner in which it was placed on the valve screw 56.

In operation, the nipple 88 of valve cap 80 extends into the passage in elastomeric sleeve 196 to push out the metal piston 198 into passage 192, which is of slightly larger diameter than that of piston 198. A gas tight seal is formed around nipple 88 by O-ring 200. When lever 132 is rotated about the axis through holes 138 and 140 through which extend the dimples or protrusions 28 and 30 on the wings 24 and 26 of head frame 12, the valve tube 120 is lifted so that gas may flow through passage 90 in nipple 88, radially through compressible regulation pad 78 and around metal disc 77, through passage 76 in O-ring carrier 74, around the elastomeric sealing member 130 and through the diametrical transverse passage 128 into axial passage 126 to burner orifice 124, where the gas is ignited by the sparks generated by actuation of the sparking wheel 154. If it becomes necessary to remove the head assembly 10 from the fuel cartridge 160, the metal piston 198 will be forced upward and partially into the passage in elastomeric sleeve 196 to prevent the escape of gas. Upon replacement of the head assembly 10, nipple 88 on valve cap 80 will once again force the metal piston 198 back into passage 192, and the lighter may be operated as before.

The advantages of the present invention, as well as certain changes and modifications to the disclosed embodiment thereof, will be readily apparent to those skilled in the art. It is the applicant's intention to cover all those changes and modifications which could be made to the embodiment of the invention herein chosen for the purposes of the disclosure without departing from the spirit and scope of the invention.

What we claim is:

1. A gas lighter comprising:
(a) a disposable fuel cartridge containing fuel under pressure and including peripheral sealing means; and
(b) head means slidably attached to and slidably detachable from said disposable fuel cartridge and fluidly coupled through said peripheral sealing means to said fuel and operative to enable valving, regulation and ignition of said fuel.

2. A gas lighter according to claim 1, wherein said disposable fuel cartridge comprises first and second retaining members defining a slot in which said head means is retained by pressure exerted by said retaining members against said head means.

3. A gas lighter according to claim 1, wherein said disposable fuel cartridge comprises a first chamber including first and second bores with a shoulder formed therebetween, and said sealing means is seated in said first bore against said shoulder.

4. A gas lighter according to claim 3, wherein said sealing means comprises a deformable, non-permeable O-ring and a lock washer, said O-ring being pressed against said shoulder by said lock washer.

5. A gas lighter according to claim 4, wherein said head means includes a nipple which extends through said O-ring in gas-tight engagement therewith.

6. A gas lighter according to claim 5, wherein said disposable fuel cartridge further comprises valve means operative to prevent the escape of fuel when said head means is slidably detached from said disposable fuel cartridge.

7. A gas lighter according to claim 6, wherein said valve means comprises:
(a) a deformable sleeve in said second bore and having a central passage formed therein;
(b) an open-ended passage extending from said second bore; and
(c) a metal piston in said open-ended passage, said piston being rounded at both ends and having a diameter slightly greater than the passage in said deformable sleeve and slightly less than said open-ended passage.

8. A gas lighter according to claim 3, wherein said disposable fuel cartridge comprises a second chamber adjacent to said first chamber, said head means being received in said first and second chambers.

9. A head assembly for combination with a disposable fuel cartridge to form a gas lighter, comprising:
(a) a head frame having a generally U-shaped cross-section and including a floor and two opposed walls extending from said floor;
(b) a flint tube having an open upper end and a cap closing its lower end, with an upper portion enclosed by said floor and opposed walls of said head frame and a lower portion extending from said head frame through said floor thereof;
(c) a valve-regulator assembly having an upper portion enclosed by said floor and opposed walls of said head frame and a lower portion extending from said head frame through said floor thereof;
(d) a lever pivotally mounted in said head frame between said opposed walls thereof and around said upper portion of said flint tube, and connected to said valve-regulator assembly; and
(e) a sparking wheel rotatably mounted in said head frame between said opposed walls thereof and adjacent said open upper end of said flint tube.

10. A head assembly according to claim 9, wherein a return spring is disposed about said upper portion of said flint tube between said lever and said head frame.

11. A head assembly according to claim 9, wherein said valve-regulator assembly comprises:
(a) a valve screw having a central bore and an upper portion enclosed by said head frame and a threaded lower portion extending from said head frame;
(b) a valve cap in rotatable engagement with the threaded lower portion of said valve screw, and having a nipple depending therefrom;
(c) regulation means disposed between said valve screw and said valve cap;
(d) a valve tube slidably positioned in said central bore of said valve screw, with a burner orifice at its upper end fluidly coupled through an axial passage to a transverse passage adjacent its lower end, and having an annular groove with which said lever is engaged; and
(e) a sealing member disposed between said lower end of said valve tube and said regulation means.

12. A head assembly according to claim 11, wherein said valve cap is formed of a material having shape memory, and having an inner diameter slightly less than the maximum outer diameter of said threaded lower portion of said valve screw.

13. A head assembly according to claim 9, wherein inwardly-deflected wings are formed in said opposed walls and protrusions are formed near the free ends of said wings and extending toward one another, said lever being pivotally mounted on said protrusions.

14. A head assembly according to claim 9, further comprising a head sleeve attached to and covering the outer surfaces of said head frame.

15. A head assembly according to claim 14, wherein said head sleeve comprises a front wall and two opposed side walls, with upper and lower rims extending perpendicularly inward from the upper and lower edges of said walls, and locking tabs extending from the ends of said head sleeve side walls and curving around the uncovered ends of said head frame opposed walls.

16. A fuel cartridge for a gas lighter, comprising:
(a) a fuel tank containing fuel under pressure;
(b) a first chamber open at one end;
(c) sealing means in said first chamber operative to slidably receive a tubular member of a head assembly and to form a seal around the tubular member; and
(d) safety valve means operative to be opened by the tubular member to establish fluid communication with said fuel tank, and further operative to close in response to the pressure of said fuel upon withdrawal of the tubular member.

17. A fuel cartridge according to claim 16, further comprising first and second opposed retaining members defining a slot for receiving a head assembly, said retaining members being deflectable by insertion of a head assembly in said slot to exert retaining pressure against the head assembly.

18. A fuel cartridge according to claim 16, wherein said first chamber includes first and second bores with a shoulder formed therebetween, and said sealing means is seated in said first bore against said shoulder.

19. A fuel cartridge according to claim 18, wherein said sealing means comprises a deformable, non-permeable O-ring and a lock washer, said O-ring being pressed against said shoulder by said lock washer.

20. A fuel catridge according to claim 18, wherein said safety valve means comprise:

(a) a deformable sleeve in said second bore and having a central passage formed therein;

(b) an open-ended passage extending from said second bore; and (c) a metal piston in said central passage of said deformable sleeve, said metal piston being rounded at both ends and having a diameter slightly greater than said passage in said deformable sleeve and slightly less than said open-ended passage, said metal piston being moveable from said central passage to said open-ended passage upon attachment of a head assembly to said fuel cartridge.

21. A fuel cartridge according to claim 16, wherein said fuel cartridge comprises a second chamber adjacent said first chamber, said first and second chambers being adapted to slidably receive a head assembly.

* * * * *